US009167857B2

(12) United States Patent
Jang et al.

(10) Patent No.: US 9,167,857 B2
(45) Date of Patent: Oct. 27, 2015

(54) WAIST BELT FOR AUTOMATICALLY MEASURING WAIST CIRCUMFERENCE

(75) Inventors: Yong-Won Jang, Daejeon (KR); In-Bum Lee, Daejeon (KR); Seung-Chul Shin, Daejeon (KR); Seung-Hwan Kim, Daejeon (KR); Seon-Hee Park, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 1192 days.

(21) Appl. No.: 12/997,774

(22) PCT Filed: Feb. 11, 2009

(86) PCT No.: PCT/KR2009/000622
§ 371 (c)(1),
(2), (4) Date: Dec. 13, 2010

(87) PCT Pub. No.: WO2010/021441
PCT Pub. Date: Feb. 25, 2010

(65) Prior Publication Data
US 2011/0106492 A1 May 5, 2011

(30) Foreign Application Priority Data
Aug. 18, 2008 (KR) ..... 10-2008-0080492

(51) Int. Cl.
*A41F 9/00* (2006.01)
*A44B 11/00* (2006.01)

(52) U.S. Cl.
CPC ..... *A41F 9/002* (2013.01); *A44B 11/005* (2013.01)

(58) Field of Classification Search
CPC ..... A41H 1/00; A41H 1/02; A41H 1/06; A41F 9/0002; A61B 5/103; A61B 5/107; G01B 7/00; G01B 7/282
USPC ..... 702/167, 164, 155
See application file for complete search history.

(56) References Cited

U.S. PATENT DOCUMENTS 4,473,949 A * 10/1984 Schechtman ..... 33/512
5,666,104 A * 9/1997 Pollack et al. ..... 340/573.1

(Continued)

FOREIGN PATENT DOCUMENTS

DE 29700923 4/1997
JP 6-22323 3/1994

(Continued)

OTHER PUBLICATIONS

Jang et al., Development of an Integrated Obesity Management Waist Belt System Composed of Calorie Tracking and Waist Circumference Measuring Module for Long Term Monitoring, Aug. 30, 2011, 33rd Annual International Conference of the IEEE EMBS, pp. 2172-2175.*

(Continued)

*Primary Examiner* — Mischita Henson
(74) *Attorney, Agent, or Firm* — Nelson Mullins Riley & Scarborough LLP

(57) ABSTRACT

Provided is a waist belt for automatically measuring a waist circumference. The waist belt includes a belt part (10) and a buckle part (20). The belt part has a plurality of magnets (11) attached thereto at a predetermined interval. The buckle part includes two or more magnetic field sensors sensing the plurality of magnets attached to the belt part, an operation processor processing and analyzing signals obtained by the magnetic field sensors, and a display displaying a measurement result of a waist circumference obtained by the operation processor.

14 Claims, 6 Drawing Sheets

(56) References Cited

U.S. PATENT DOCUMENTS

| | | | | |
|---|---|---|---|---|
| 6,551,234 | B1 * | 4/2003 | Martello | 600/15 |
| 2002/0104151 | A1 | 8/2002 | Rauscher | |
| 2004/0102684 | A1 * | 5/2004 | Kawanishi et al. | 600/300 |
| 2006/0149172 | A1 * | 7/2006 | Brinston, Sr. | 601/61 |
| 2006/0288781 | A1 * | 12/2006 | Daumer et al. | 73/510 |
| 2007/0167106 | A1 | 7/2007 | Hoover | |
| 2007/0214550 | A1 | 9/2007 | Bongiovanni | |
| 2012/0172747 | A1 * | 7/2012 | Fukuda et al. | 600/547 |

FOREIGN PATENT DOCUMENTS

| | | |
|---|---|---|
| JP | 2000-155037 | 6/2000 |
| KR | 10-227629 | 8/1998 |
| KR | 20-0241939 | 9/2001 |
| KR | 20-0256206 | 12/2001 |
| KR | 20-0352466 | 6/2004 |
| KR | 1020050050350 | 5/2005 |

OTHER PUBLICATIONS

Jang et al., A Basic Study for Automatic Waist Circumference Measurement Using Magnet with Waist Belt to Assist Obese Management in Daily Life, Aug. 20, 2008, 30th Annual International IEEE EMBS Conference, pp. 2333-2336.*

International Search Report for Application No. PCT/KR2009/000622, dated May 6, 2009.

* cited by examiner

WAIST BELT FOR AUTOMATICALLY MEASURING WAIST CIRCUMFERENCE

RELATED APPLICATIONS

This application is a 35 U.S.C. §371 national stage filing of PCT Application No. PCT/KR2009/000622 filed on Feb. 11, 2009, which claims priority to, and the benefit of, Korean Patent Application No. 10-2008-0080492 filed on Aug. 18, 2008. The contents of the aforementioned applications are hereby incorporated by reference.

TECHNICAL FIELD

The present invention relates to a waist belt for automatically measuring a waist circumference, and more particularly, to a waist belt for automatically measuring a waist circumference of a belt wearer by attaching a plurality of magnets to a belt part at a predetermined interval and attaching magnetic field sensors for sensing the magnets to a buckle part.

BACKGROUND ART

Recently, as interests in health increase and obese or overweight population increases due to supernutrition and a lack of exercise, the importance of health care has been emphasized. Accordingly, many people make an effort to maintain their health by themselves or by the help of experts.

Specially, because a waist circumference may be recognized as an indicator of one's health condition, it is important to observe the variation according to time by periodically measuring the waist circumference. A conventional waist belt for measuring the waist circumference uses such a manner that a user checks his waist circumference using a tapeline attached to the inner surface of the belt, or that the user is informed of a change of his waist circumference instead of the dimension of his waist circumference.

However, the manner using the tapeline has such an inconvenience that the user should directly check the scale of the tapeline and remember the measured value. Also, in the manner of informing the user of the increase and decrease of the waist circumference, it is impossible to know the exact waist circumference. Furthermore, this manner has a limitation in its effectiveness because the dimension deviation of the waist circumference may vary according to whether measured before or after a meal, or whether the user changes his pants.

DISCLOSURE OF INVENTION

Technical Problem

An aspect of the present invention provides a waist belt configured to automatically measure a waist circumference of a belt wearer by arranging a plurality of magnets to a belt part at a predetermined interval and attaching magnetic field sensors for sensing the magnets to a buckle part.

Technical Solution

According to an aspect of the present invention, there is provided a waist belt for automatically measuring a waist circumference including a belt part having a plurality of magnets attached thereto at a predetermined interval; and a buckle part including: two or more magnetic field sensors sensing the plurality of magnets attached to the belt part; an operation processor processing and analyzing signals obtained by the magnetic field sensors; and a display displaying a measurement result of a waist circumference obtained by the operation processor.

Polarities of the plurality of magnets may be alternately disposed. An interval between the magnetic field sensors may be an integer ±¼ or ±½ times an interval between the magnets.

The buckle part may further include a user manipulating unit to receive a manipulating input from a user; and a guard to prevent the belt part from shaking when the belt part is inserted into the buckle part.

The buckle part may further include a storage storing the measurement result of the waist circumference obtained by the operation processor and a transmitter transmitting the measurement result of the waist circumference stored in the storage to an external terminal in a wired or wireless manner. In this case, the external terminal may include a personal computer, a personal digital assistant (PDA), and a mobile terminal.

Advantageous Effects

A waist belt according to the present invention can automatically measure a waist circumference without a user's consciousness. Also, a user can check his health condition by checking variation of his waist circumference during a certain period of time since each measurement result of the waist circumference is stored together with measurement time. Furthermore, the waist belt according to the present invention can promote a user's awareness of his health and give the user a motive of healthcare, and is useful to manage a user's overweight.

BRIEF DESCRIPTION OF DRAWINGS

The above and other aspects, features and other advantages of the present invention will be more clearly understood from the following detailed description taken in conjunction with the accompanying drawings, in which.

BEST MODE FOR CARRYING OUT THE INVENTION

Figure 1:
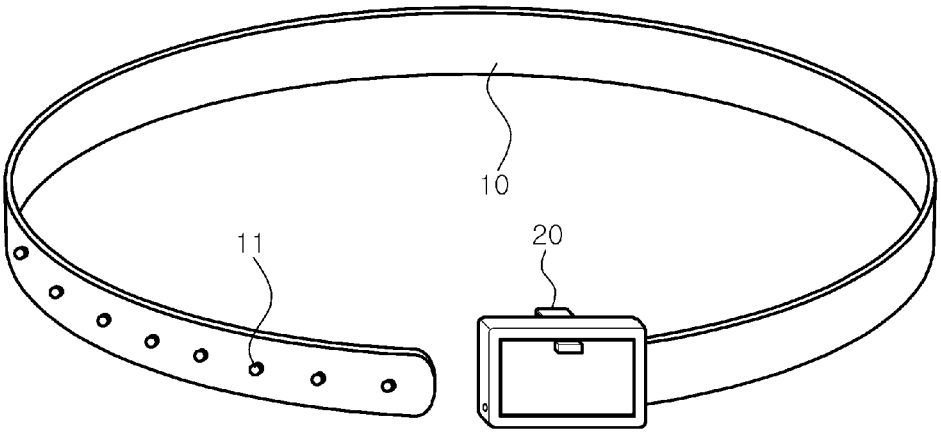
FIG. 1 is a perspective view of a waist belt for automatically measuring a waist circumference according to an embodiment of the present invention.

Exemplary embodiments of the present invention will now be described in detail with reference to the accompanying drawings so that a person skilled in the art can easily implement the present invention. However, the detailed description of relevant known functions or configurations will be omitted so as not to obscure the essential point of the present invention. Also, like reference numerals refer to like elements throughout the drawings.

FIG. 1 is a perspective view of a waist belt for automatically measuring a waist circumference according to an embodiment of the present invention. As described in FIG. 1, the waist belt for automatically measuring a waist circumference includes a belt part 10 and a buckle part 20. The waist belt may be configured as a belt form which is fixed using a common ratchet.

A plurality of magnets 11 are attached to the belt part 10 at a predetermined interval. In this case, the number of the magnets 11 attached to the belt part 10 may be appropriately selected according to an arrangement spacing of the magnets 11 so as to cover the minimum value to the maximum value of the waist circumference to be measured. Also, the plurality of magnets 11 may be arranged so that their polarities appear alternately in order to raise the sensitivity. In this embodiment of the present invention, a plurality of 4 pi×1 mm cylinder-type magnets 11 are attached to the outer surface of the belt part 10 at an interval of 1 cm, but not limited thereto.

Hereinafter, a configuration of the buckle part 20 will be fully described with reference to FIGS. 2 to 4.

Figure 2:
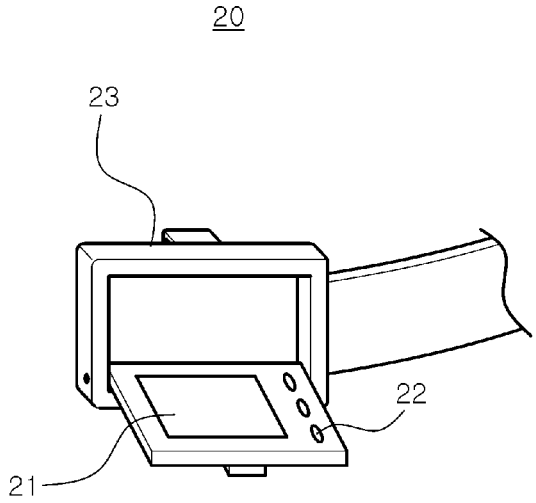
FIG. 2 is a detailed view illustrating a front surface of a buckle part of the waist belt for automatically measuring a waist circumference as described in FIG. 1.

FIG. 2 is a detailed view illustrating a front surface of a buckle part of the waist belt for automatically measuring a waist circumference as described in FIG. 1. FIG. 3 is a detailed view illustrating a rear surface of the buckle part of the waist belt for automatically measuring a waist circumference as described in FIG. 1. FIG. 4 is an exploded view of the rear surface of the buckle part as described in FIG. 3.

Figure 3:
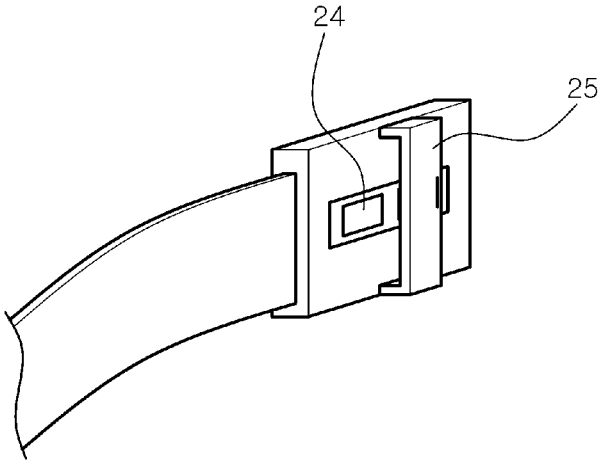
FIG. 3 is a detailed view illustrating a rear surface of the buckle part of the waist belt for automatically measuring a waist circumference as described in FIG. 1.
Figure 4:
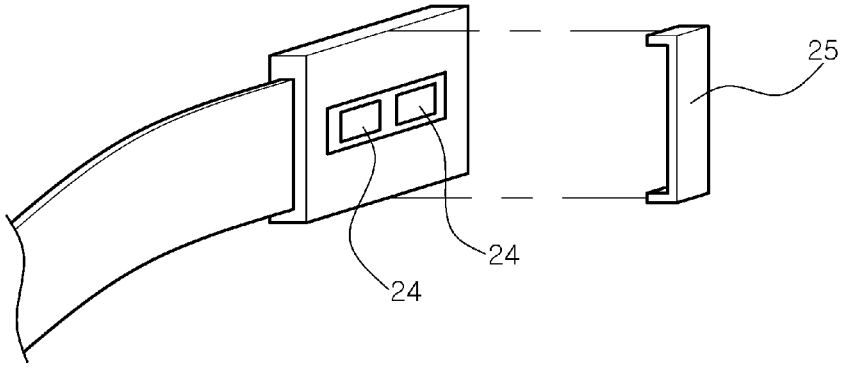
FIG. 4 is an exploded view of the rear surface of the buckle part as described in FIG. 3.

Referring to FIGS. 2 to 4, the buckle part 20 includes a display 21, a user manipulating unit 22, a housing 23, two or more magnetic field sensors 24, and a guard 25. The display 21 displays a result of measurement and analysis of the waist circumference. The user manipulating unit 22 receives an input relevant to a belt manipulation from a user. The housing 23 has a hollow shape to receive the display 21 in the buckle part 20. The two or more magnetic field sensors 24 sense the plurality of magnets attached to the belt part 10. For a stable sensing, the guard 25 prevents the belt part 10 from shaking when the belt part 10 is inserted into the buckle part 20.

Also, although not shown in FIGS. 2 to 4, an operation processor, storage, and a transmitter may be embedded into the housing 23 in order to store the measurement result by analyzing signals obtained by the magnetic field sensors 24 and, if necessary, transmit the measurement result to an external terminal.

More concretely, the display 21 included in the buckle part 20 is folded into the housing 23 at ordinary times. However, when the user intends to see the measurement result of his waist circumference, the display 21 may be unfolded forward as described in FIG. 2. Also, the user manipulating unit 22 is provided on a side of the front surface of the display 21 to receive the input from the user.

Also, two or more magnetic field sensors 24 are horizontally disposed on the rear surface of the buckle part 20. The magnetic field sensors 24 are embedded into the housing 23 of the buckle part 20 so as not to be an obstacle when the belt part 10 passes the buckle part 20 through the guard 25. In this case, the top surface of the magnetic field sensors 24 may be embedded in alignment with the surface of the housing 23. The guard 25 enables the belt part 10 to pass through the buckle part 20 so that the magnet 11 attached to belt part 10 may be spaced from the magnetic field sensors 24 by a constant distance. Thus, the guard 25 enables a stable sensing.

Two magnetic field sensors 24 are used in this embodiment. In this case, the resolution of the two magnetic field sensors 24 becomes a half of magnet arrangement spacing. By using two magnetic field sensors 24, it is possible to discriminate between the forward movement and the backward movement of the belt part 10 when the belt part 10 passes through the buckle part 20. Also, the magnetic field sensors 24 are disposed at an interval of an integer ±¼ or ±½ times the arrangement spacing of the magnets 11 attached to belt part 10. For example, when the magnets 11 are disposed at an interval of 1 cm, the magnetic field sensors 24 may be at an interval of 0.25, 0.75, 1.25 and 1.75, . . . cm or 0.5, 1.5 and 2.5, . . . cm. In this embodiment, the magnetic field sensors 24 are arranged at an interval of 0.75 cm, which is three quarters times the arrangement spacing of the magnets 11.

The operation processor, the storage and the transmitter may be embedded into the housing 23. Signals obtained by the magnetic field sensors 24 may be processed by the operation processor. The measurement result may be stored in the storage, or transmitted in a wired or wireless manner to an external terminal such as a personal computer, a personal digital assistant (PDA), and a mobile phone. In this case, the measurement results may be displayed, stored, and transmitted every measurement time.

The frequency and form of the storage and the transmission may be embodied in various manners. For example, the measurement results are stored every measurement time, but the measurement results may be transmitted to the external terminal only when there is a transmission request. Also, the transmission of the measurement results may be deferred until the measurement results are collected during a certain period of time. Thus, various designs are possible according to user's demands.

The external terminal receiving the measurement results from the waist belt for automatically measuring a waist circumference may analyze the measurement results using a devised program. The program may be configured to analyze the variation of the waist circumference for a certain duration using the measurement results, or inform the user of the variation of the waist circumference. Also, to enhance the accuracy of the measurement of the waist circumference, the program may be configured to be insensible to a variation of the waist circumference in accordance with user's daily life such as change of pants, and a variation of the waist circumference between before and after a meal.

Figure 5:
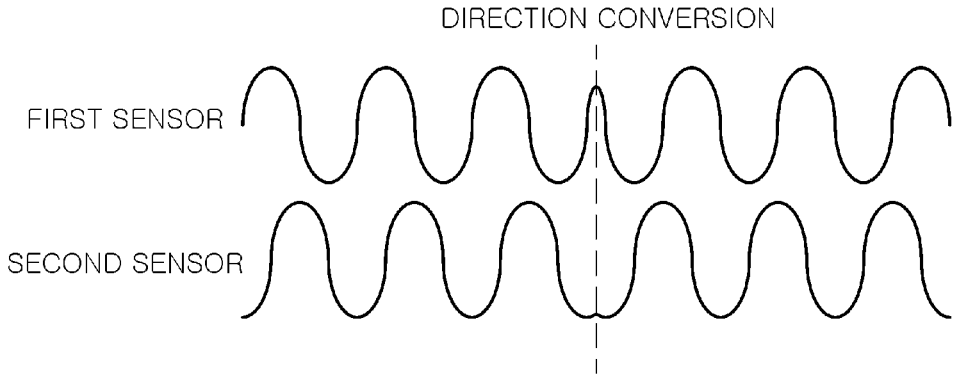
FIG. 5 is a view illustrating a waveform change in accordance with a movement and a movement direction conversion of the belt part.

FIG. 5 is a view illustrating a waveform change in accordance with a movement and a movement direction conversion of the belt part.

First, when a user wears the waist belt according to an embodiment of the present invention, the belt part 10 disposed with the magnets 11 is inserted into the buckle part 20 through the guard 25. In this case, different number of magnets 11 according to the degree fastening the belt sequentially passes by the surface of the magnetic field sensors 24. Accordingly, two magnetic field sensors 24 sequentially show the electric response by the magnets 11.

If the magnets 11 attached to belt part 10 pass by the magnetic field sensors 24 at a constant speed, and if the spacing of two magnetic field sensors 24 and the spacing of the magnets 11 have ±¼ time difference, a signal obtained by a first magnetic field sensor and a signal obtained by a second magnetic field sensor show a ±¼ phase difference.

FIG. 5 shows a waveform of the measurement result according to the above embodiment. The spacing between the magnetic field sensors 24 is 0.75 cm, and the spacing between the magnets 11 is 1 cm. Also, a waveform when the movement direction of belt part 10 is converted is shown in the FIG. 5. When the movement direction is converted, the waveform shows a property that is symmetrical about a transition point of the movement direction conversion. Accordingly, by using this property, it is possible to discriminate between the forward movement and the backward movement of belt part 10.

Figure 6:
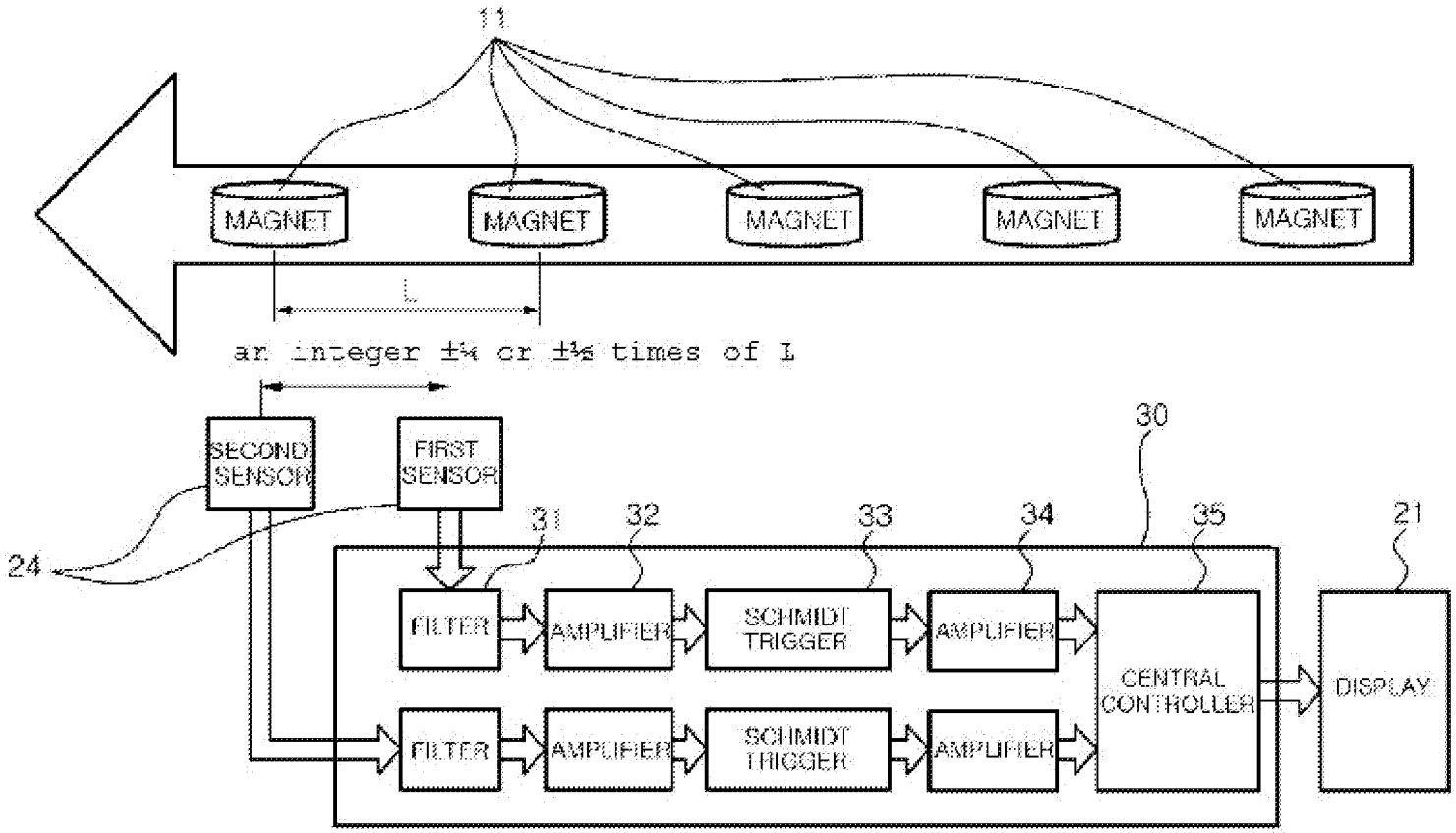
FIG. 6 is a detailed block diagram illustrating an operation processor of the waist belt for automatically measuring a waist circumference according to an embodiment of the present invention.

FIG. 6 is a detailed block diagram illustrating an operation processor of a waist belt for automatically measuring a waist circumference according to an embodiment of the present invention.

As described in FIG. 6, signals obtained by two magnetic field sensors 24 are inputted into a central controller 35 through filters 31, amplifiers 32, Schmidt triggers 33 and amplifiers 34, respectively. The central controller 35 may be implemented by a microcontroller etc. The central controller 35 processes the signals which go through the above process, and displays the result on the display 21. Also, the result may be stored in the storage, or transmitted to an external terminal through the transmitter as described above.

The present invention should not be construed as limited to the above embodiments or the appended drawings. While the present invention has been shown and described in connection with the exemplary embodiments, it will be apparent to those skilled in the art that modifications and variations can be made without departing from the spirit and scope of the invention as defined by the appended claims.

The invention claimed is:

1. A waist belt for automatically measuring a waist circumference comprising:

a belt part having a plurality of magnets attached thereto at a predetermined interval between each of the plurality of magnets; and a buckle part comprising:

two or more magnetic field sensors sensing the plurality of magnets attached to the belt part;

an operation processor processing and analyzing signals obtained by the magnetic field sensors to calculate a waist circumference according to the plurality of magnets that the two or more magnetic field sensors sensed and the predetermined interval between each of the plurality of magnets; and a display displaying a measurement result of the calculated waist circumference.

2. The waist belt of claim 1, wherein polarities of the plurality of magnets are alternately disposed.

3. The waist belt of claim 1, wherein the buckle part further comprises a user manipulating unit to receive a manipulating input from a user.

4. The waist belt of claim 1, wherein the buckle part further comprises a guard to prevent the belt part from shaking when the belt part is inserted into the buckle part.

5. The waist belt of claim 1, wherein an interval between the magnetic field sensors is an integer close to a value which is ±¼ or ±½ times the predetermined interval between the magnets that are attached to the belt part.

6. The waist belt of claim 1, wherein the buckle part further comprises a storage storing the measurement result of the calculated waist circumference obtained by the operation processor.

7. The waist belt of claim 6, wherein the buckle part further comprises a transmitter transmitting the measurement result of the calculated waist circumference stored in the storage to an external terminal in a wired or wireless manner.

8. The waist belt of claim 7, wherein the external terminal comprises a personal computer, a personal digital assistant (PDA), and a mobile terminal.

9. A waist belt for automatically measuring a waist circumference comprising:

a belt part having a plurality of magnets attached thereto at a predetermined interval between each of the plurality of magnets; and a buckle part comprising:

two or more magnetic field sensors sensing the plurality of magnets attached to the belt part;

an operation processor processing and analyzing signals obtained by the magnetic field sensors to calculate the waist circumference according to the plurality of magnets that the two or more magnetic field sensors sensed and the predetermined interval between the each of the plurality of magnets;

a storage storing a measurement result of the calculated waist circumference; and a transmitter transmitting the measurement result of the calculated waist circumference stored in the storage to an external terminal in a wire or wireless manner.

10. The waist belt of claim 9, wherein polarities of the plurality of magnets are alternately disposed.

11. The waist belt of claim 9, wherein the buckle part further comprises a user manipulating unit to receive a manipulating input from a user.

12. The waist belt of claim 9, wherein the buckle part further comprises a guard to prevent the belt part from shaking when the belt part is inserted into the buckle part.

13. The waist belt of claim 9, wherein an interval between the magnetic field sensors is an integer close to a value which is ±¼ or ±½ times of the predetermined interval between the magnets that are attached to the belt part.

14. The waist belt of claim 9, wherein the external terminal comprises a personal computer, a personal digital assistant (PDA), and a mobile terminal.

* * * * *